US009879703B2

(12) United States Patent
Kobayashi

(10) Patent No.: US 9,879,703 B2
(45) Date of Patent: Jan. 30, 2018

(54) FLUID PRESSURE CYLINDER

(71) Applicant: KYB Corporation, Tokyo (JP)

(72) Inventor: Toshio Kobayashi, Gifu (JP)

(73) Assignee: KYB Corporation, Tokyo (JP)

( * ) Notice: Subject to any disclaimer, the term of this patent is extended or adjusted under 35 U.S.C. 154(b) by 203 days.

(21) Appl. No.: 14/905,296

(22) PCT Filed: Jul. 22, 2014

(86) PCT No.: PCT/JP2014/069363

§ 371 (c)(1),
(2) Date: Jan. 15, 2016

(87) PCT Pub. No.: WO2015/016104

PCT Pub. Date: Feb. 5, 2015

(65) Prior Publication Data

US 2016/0177982 A1 Jun. 23, 2016

(30) Foreign Application Priority Data

Jul. 31, 2013 (JP) ..... 2013-158827

(51) Int. Cl.
*F01B 31/12* (2006.01)
*F15B 15/28* (2006.01)

(52) U.S. Cl.
CPC ..... *F15B 15/2861* (2013.01); *F15B 15/2815* (2013.01); *F15B 15/2892* (2013.01)

(58) Field of Classification Search
CPC ..... F15B 15/2815; F15B 15/2861; F15B 15/2892
USPC ..... 92/5 R; 91/1
See application file for complete search history.

(56) References Cited

U.S. PATENT DOCUMENTS 5,150,049 A * 9/1992 Schuetz ..... F15B 15/2892 92/5 R
6,509,733 B2 * 1/2003 Blubaugh ..... F15B 15/2892 92/5 R
6,725,761 B1 * 4/2004 McNaughton ..... F15B 15/2892 92/5 R
7,023,199 B2 * 4/2006 Blubaugh ..... F15B 15/2815 324/207.13

(Continued)

FOREIGN PATENT DOCUMENTS

CN 201554714 U 8/2010
DE 10044984 A1 3/2002

(Continued)

*Primary Examiner* — Michael Leslie
(74) *Attorney, Agent, or Firm* — Rabin & Berdo, P.C.

(57) ABSTRACT

A fluid pressure cylinder includes a cylinder tube, a piston rod, and a displacement sensor. A bottom portion of the cylinder tube has: a pin hole formed in a direction orthogonal to a center axis; and a through hole penetrating the bottom portion through the pin hole. The displacement sensor has: a sensor body disposed on inner side of the pin hole in the through hole; a sensor rod provided so as to extend from the sensor body; and an annular magnet relatively movable with respect to the sensor rod. The through hole has: a reduced-diameter portion; and a female screw portion that has a female screw formed on an inner circumference of the female screw portion. The sensor body is fixed by being pressed by a plug that is screwed into the female screw portion and by being engaged with the reduced-diameter portion.

6 Claims, 1 Drawing Sheet

(56) References Cited

U.S. PATENT DOCUMENTS

| | | | | |
|---|---|---|---|---|
| 7,059,238 | B2 * | 6/2006 | Albright | F15B 15/2815 92/5 R |
| 7,121,185 | B2 * | 10/2006 | Alrefai | F15B 15/2815 92/5 R |
| 7,284,472 | B1 * | 10/2007 | Soellner | G01D 11/245 92/5 R |
| 9,482,245 | B2 * | 11/2016 | Palmer | F15B 15/2892 |
| 2013/0174727 | A1 | 7/2013 | Palmer et al. | |

FOREIGN PATENT DOCUMENTS

| | | | |
|---|---|---|---|
| EP | 1942281 | A1 | 7/2008 |
| JP | 2007-071363 | A | 3/2007 |

* cited by examiner

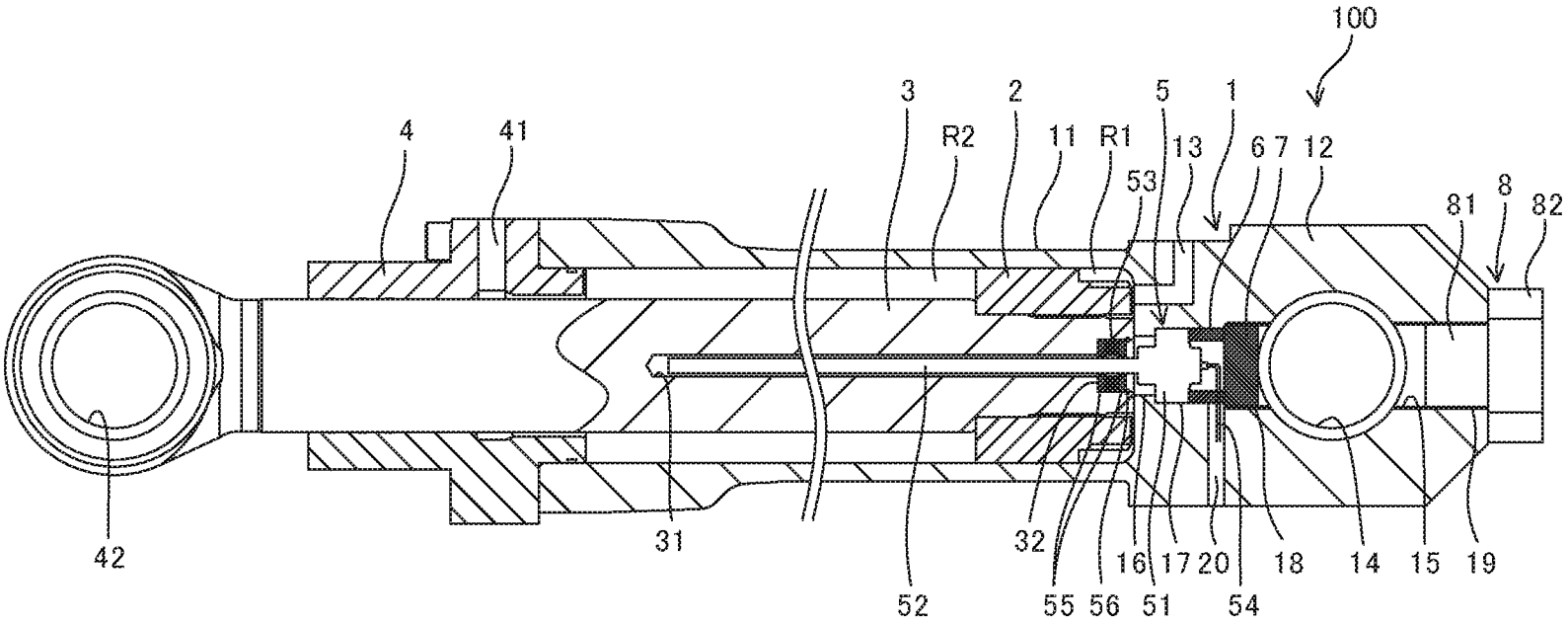
100
1
2
3
4
5
6
7
8
11
12
13
14
15
16
17
18
19
20
31
32
41
42
51
52
53
54
55
56
81
82
R1
R2

FLUID PRESSURE CYLINDER

TECHNICAL FIELD

The present invention relates to a fluid pressure cylinder.

BACKGROUND ART

A fluid pressure cylinder includes a cylindrical cylinder tube, a piston that is inserted into the cylinder tube in a freely slidable manner, a piston rod that is linked to the piston, and a cylinder head that is fitted to an open end of the cylinder tube and supports the piston rod in a slidable and rotatable manner.

The fluid pressure cylinder further includes a lower clevis that is linked to a base portion of the cylinder tube, and an upper clevis that is linked to an end portion of the piston rod on the opposite side of the piston. The fluid pressure cylinder is linked to an equipment via the lower clevis and the upper clevis.

JP2007-71363A discloses a fluid pressure cylinder having a built-in magnetostrictive displacement sensor that detects relative displacement between a piston rod and a cylinder tube. The magnetostrictive displacement sensor consists of a sensor body, a sensor rod that is provided so as to extend from the sensor body, and an annular magnet disposed on an outer circumference of the sensor rod.

The sensor body is disposed on the outer side of the base portion of the cylinder tube. One end of the sensor rod is inserted into a hollow portion formed in the piston rod, and other end thereof is linked to the sensor body via a hole formed in the base portion of the cylinder tube. The magnet having the annular shape is disposed in the hollow portion of the piston rod so as to face against the outer circumference of the sensor rod.

SUMMARY OF INVENTION

In the above-described conventional technique, because the sensor body is disposed at the outer side of the base portion of the cylinder tube, the sensor body is accommodated within a hollow part of a bracket having the lower clevis. Therefore, a mounting length of the fluid pressure cylinder is increased by the length of the sensor body, thereby deteriorating mountability to the equipment.

An object of the present invention is to improve mountability of a fluid pressure cylinder having a built-in displacement sensor.

According to one aspect of the present invention, a fluid pressure cylinder includes: a cylinder tube having a bottomed cylindrical shape; a piston rod inserted into the cylinder tube, the piston rod having, at a tip end on insertion-side, a piston that slidingly contacts with the cylinder tube; and a displacement sensor configured to detect relative displacement between the piston rod and the cylinder tube. A bottom portion of the cylinder tube has: a pin hole formed in a direction orthogonal to a center axis of the cylinder tube; and a through hole formed in the axial direction of the cylinder tube so as to penetrate the bottom portion through the pin hole. The displacement sensor has: a sensor body disposed on inner side of the pin hole in the through hole; a sensor rod provided so as to extend from the sensor body, the sensor rod being inserted into an axial hole formed in the piston rod in the axial direction; and an annular magnet provided on the piston rod such that an inner circumference of the magnet faces against the sensor rod, the annular magnet being relatively movable with respect to the sensor rod. The through hole has: a reduced-diameter portion having an inner diameter smaller than other portions; and a female screw portion provided on outer side of the reduced-diameter portion, the female screw having a female screw formed on an inner circumference of the female screw portion. The sensor body is fixed by being pressed by a plug that is screwed into the female screw portion and by being engaged with the reduced-diameter portion.

BRIEF DESCRIPTION OF DRAWING

FIG. 1 is a sectional view showing a fluid pressure cylinder according to an embodiment of the present invention.

DESCRIPTION OF EMBODIMENT

With reference to the drawing, an embodiment of the present invention will be described.

FIG. 1 is a sectional view showing a fluid pressure cylinder 100 in this embodiment.

The fluid pressure cylinder 100 is the fluid pressure cylinder 100 of a double acting type including a cylinder tube 1 having a bottomed cylindrical shape, a piston 2 that is inserted into the cylinder tube 1 in a freely slidable manner, a piston rod 3 that is linked to the piston 2 at a tip end thereof on the insertion side into the cylinder tube 1, a cylinder head 4 that is fit to an open end of the cylinder tube 1 and supports the piston rod 3 in a slidable and rotatable manner, and a displacement sensor 5 that detects relative displacement between the piston rod 3 and the cylinder tube 1.

The cylinder tube 1 includes a hollow tube 11 that defines a fluid chamber therein and a bottom portion 12 that is provided on a base portion of the tube 11. The fluid chamber is partitioned by the piston 2 into a piston-side chamber R1 on the bottom portion 12 side and a rod-side chamber R2 on the cylinder head 4 side. The piston-side chamber R1 communicates with a supply/discharge port 13 formed in the bottom portion 12, and the rod-side chamber R2 communicates with a supply/discharge port 41 formed in the cylinder head 4.

As working fluid is supplied to the piston-side chamber R1, the piston 2 and the piston rod 3 slide leftward in FIG. 1, and the fluid pressure cylinder 100 undergoes extension operation. On the other hand, as the working fluid is supplied to the rod-side chamber R2, the piston 2 and the piston rod 3 slide rightward in FIG. 1, and the fluid pressure cylinder 100 undergoes contraction operation.

A pin hole 14 is provided so as to penetrate the bottom portion 12 of the cylinder tube 1 in the direction orthogonal to the center axis of the cylinder tube 1. In addition, a pin hole 42 is provided so as to penetrate an end portion of the piston rod 3 on the opposite side of the piston 2 in the direction orthogonal to the center axis of the piston rod 3 in a similar manner. These pin holes 14 and 42 function as devises, and are used to link the fluid pressure cylinder 100 with the equipment on which the fluid pressure cylinder 100 is to be mounted. In a case in which the fluid pressure cylinder 100 is linked to a boom of an operating machinery, for example, it is possible to raise and lower the boom in response to extension/contraction operation of the fluid pressure cylinder 100.

Furthermore, a through hole 15 is formed in the bottom portion 12 of the cylinder tube 1 so as to penetrate the bottom portion 12 from the outer side to the inner side in the axial direction through the pin hole 14. In other words, the through hole 15 is formed so as to penetrate the bottom portion 12 from a right end in FIG. 1 to the piston-side chamber R1, thereby intersecting with the pin hole 14 at an intermediate position thereof. An inner diameter of the through hole 15 is set so as to become smaller than an inner diameter of the pin hole 14.

The through hole 15 has a reduced-diameter portion 16 having an inner diameter smaller than the other portions, a sensor holding portion 17 that holds a sensor body 51, which will be described later, a female screw portion 18 that has a female screw formed on an inner circumference thereof, and an outer-side female screw portion 19 that is provided at the outer side of the pin hole 14 and has a female screw formed on an inner circumference thereof, in this order from the piston-side chamber R1 side.

Furthermore, in the bottom portion 12 of the cylinder tube 1, a wire guide hole 20 is formed such that one end thereof opens at the sensor holding portion 17 and other end thereof opens at a side surface of the bottom portion 12.

The piston 2 is a cylindrical member having a female screw formed on an inner circumference thereof, and is fixed to a male screw formed on an outer circumference of the insertion-side tip end of the piston rod 3 by being screwed from the tip end of the piston rod 3. An axial hole 31 is formed in the piston rod 3 by being drilled in the axial direction of the piston rod 3 from a tip end surface thereof. The depth of the axial hole 31 from the tip end surface is set so as to become longer than a stroke length of the piston rod 3. On an opening portion of the axial hole 31, an increased-diameter portion 32 having a greater inner diameter than that of the axial hole 31 is formed.

The displacement sensor 5 has the sensor body 51, a sensor rod 52 that is provided so as to extend from the sensor body 51, and an annular magnet 53 that is disposed on an outer circumference of the sensor rod 52.

The sensor body 51 is disposed on the sensor holding portion 17 in the through hole 15 so as to be in contact with the reduced-diameter portion 16 along the axial direction. A wire 54 that extends from a back side of the sensor body 51 is guided to the outside through the wire guide hole 20 of the bottom portion 12.

The sensor rod 52 is inserted into the axial hole 31 in the piston rod 3 through the through hole 15. An outer diameter of the sensor rod 52 is set so as to become smaller than the inner diameter of the axial hole 31, and the sensor rod 52 and the piston rod 3 can be displaced relative to each other.

The magnet 53 is disposed on the increased-diameter portion 32 of the piston rod 3 and is sandwiched by two annular spacers 55. The magnet 53 and the two spacers 55 are fit to the increased-diameter portion 32 and are fixed in the increased-diameter portion 32 by a snap ring 56. An inner diameter of the magnet 53 is set so as to be larger than the outer diameter of the sensor rod 52, thereby preventing wearing out of the magnet 53 in a situation in which the sensor rod 52 and the piston rod 3 undergo relative displacement.

The displacement sensor 5 transmits an excitation pulse from the sensor body 51 to a magnetostrictive line in the sensor rod 52. A mechanical strain pulse is generated due to an external magnetic field of the magnet 53 acting on the excitation pulse. The distance between the sensor body 51 and the magnet 53 is calculated by the displacement sensor 5 on the basis of the time from the transmission of the excitation pulse to the return of the strain pulse. Thus, the displacement sensor 5 detects relative positions of the piston rod 3 and the cylinder tube 1, in other words, a stroke amount of the fluid pressure cylinder 100.

A cylindrical collar 6 is provided on the outer side of the sensor body 51 in the sensor holding portion 17 of the through hole 15. The collar 6 has a hole (not shown) for inserting the wire at a position corresponding to the wire guide hole 20.

A plug 7 having a male screw formed on an outer circumference thereof is screwed into the female screw portion 18 of the through hole 15. The plug 7 has a substantially columnar shape and a hexagonal hole (not shown) for tightening the plug at the outer surface in the axial direction. The sensor body 51 is fixed by being pressed via the collar 6 by the plug 7 that is tightened from the outer side in the axial direction and by being engaged with the reduced-diameter portion 16. The shape of the hole for tightening the plug 7 is not limited to the hexagonal shape and may have other shapes.

At the outer side of the pin hole 14 in the through hole 15, an outer plug 8 is provided. The outer plug 8 has a screw portion 81 having a male screw formed on an outer circumference thereof and a large-diameter portion 82 having a larger diameter than the screw portion 81. By screwing the screw portion 81 of the outer plug 8 into the outer-side female screw portion 19 of the through hole 15, the through hole 15 is closed.

The plug 7 is positioned at the inner side of the pin hole 14 in the axial direction in a state in which the plug 7 is tightened to the female screw portion 18. In addition, the outer plug 8 is positioned such that a tip end of the screw portion 81 is positioned at the outer side of the pin hole 14 in the axial direction in a state in which the outer plug 8 is tightened to the outer-side female screw portion 19. With such a configuration, when the fluid pressure cylinder 100 is mounted on an equipment, the plug 7 and the outer plug 8 are prevented from interfering with a pin inserted in the pin hole 14.

The fluid pressure cylinder 100 is configured as described above and is extended/contracted by supplying/discharging the working fluid to/from the fluid chamber. As the fluid pressure cylinder 100 is extended/contracted, the sensor rod 52 and the piston rod 3 undergo relative displacement in a corresponding manner. Accordingly, the distance between the magnet 53 and the sensor body 51 in the axial direction is changed, the relative positions of the piston rod 3 and the cylinder tube 1 are detected, and in turn, the stroke amount of the fluid pressure cylinder 100 is detected.

According to the embodiment mentioned above, the advantages described below are afforded.

The sensor body 51 is disposed in the through hole 15 formed in the bottom portion 12 and is fixed by being pressed by the plug 7 screwed into the female screw portion 18 and by being engaged with the reduced-diameter portion 16. Therefore, it is possible to improve mountability of the fluid pressure cylinder 100 by suppressing increase in the mounting length of the fluid pressure cylinder 100 while having the sensor body 51 built into the cylinder tube 1.

Furthermore, it is possible to insert the sensor body 51 and the sensor rod 52 from the outer side of the through hole 15, whereby it is possible to dismount the sensor body 51 and the sensor rod 52 only by removing the outer plug 8 and the plug 7 without disassembling the fluid pressure cylinder 100. Thus, it is possible to inspect and exchange the sensor body 51 and the sensor rod 52 with ease.

Furthermore, because the sensor body 51 is fixed to the reduced-diameter portion 16 by being pressed by the plug 7, it is possible to prevent the sensor body 51 from moving in the axial direction when pressure is applied from the fluid chamber.

Furthermore, it is possible to improve a tensile strength of the fluid pressure cylinder 100 compared to a case in which the sensor body 51 is disposed at the outer side of the bottom portion 12 and is accommodated in a bracket having a clevis.

Furthermore, because the cylindrical collar 6 is provided between the sensor body 51 and the plug 7, it is possible to define a space between the sensor body 51 and the plug 7 for guiding the wire 54 extending out from the sensor body 51.

Furthermore, because tightening force by the plug 7 acts only on an outer circumferential portion of the sensor body 51 via the collar 6, it is possible to reliably fix the sensor body 51 on the bottom portion 12 without increasing strength of the central portion of the sensor body 51.

Furthermore, it is possible to press and fix the sensor body 51 by rotating the plug 7 in a state in which the positions of the hole provided in the collar 6 for inserting the wire 54 and the wire guide hole 20 in the circumferential direction are held.

Furthermore, because the outer plug 8 is screwed at the outer side of the pin hole 14 in the through hole 15, it is possible to close the through hole 15 at the outer side of the pin hole 14, except a case in which a tool needs to be accessed to the plug 7. Therefore, it is possible to improve rigidity of the whole bottom portion 12.

Furthermore, in a case in which the fluid pressure cylinder 100 is linked to the equipment onto which the fluid pressure cylinder 100 is to be mounted, a collar, a pin bush, a bush, a pin, or the like is inserted into the pin hole 14. In such a case, because the collar, the pin bush, the bush, the pin, or the like inserted into the pin hole 14 can hold the plug 7, the plug 7 is prevented from falling off from the through hole 15.

Embodiments of this invention were described above, but the above embodiments are merely examples of applications of this invention, and the technical scope of this invention is not limited to the specific constitutions of the above embodiments.

For example, in the above-mentioned embodiment, although the sensor body 51 is pressed against the reduced-diameter portion 16 via the collar 6 by tightening the plug 7 into the female screw portion 18, an O-ring may be interposed at a part where the sensor body 51 and the reduced-diameter portion 16 are brought into contact. With such a configuration, it is possible to prevent the working fluid in the piston-side chamber R1 from leaking out towards the outer side of the sensor body 51 in the axial direction.

This application claims priority based on Japanese Patent Application No. 2013-158827 filed with the Japan Patent Office on Jul. 31, 2013, the entire contents of which are incorporated into this specification.

The invention claimed is:

1. A fluid pressure cylinder comprising:

a cylinder tube having a bottomed cylindrical shape;

a piston rod inserted into the cylinder tube, the piston rod having, at a tip end on insertion-side, a piston that slidingly contacts with the cylinder tube; and a displacement sensor configured to detect relative displacement between the piston rod and the cylinder tube; wherein a bottom portion of the cylinder tube has: a pin hole formed in a direction orthogonal to a center axis of the cylinder tube; and a through hole formed in the axial direction of the cylinder tube so as to penetrate the bottom portion through the pin hole, the displacement sensor has: a sensor body disposed on inner side of the pin hole in the through hole; a sensor rod provided so as to extend from the sensor body, the sensor rod being inserted into an axial hole formed in the piston rod in the axial direction; and an annular magnet provided on the piston rod such that an inner circumference of the magnet faces against the sensor rod, the annular magnet being relatively movable with respect to the sensor rod, the through hole has: a reduced-diameter portion having an inner diameter smaller than other portions; and a female screw portion provided on outer side of the reduced-diameter portion, the female screw having a female screw formed on an inner circumference of the female screw portion, and the sensor body is fixed by being pressed by a plug that is screwed into the female screw portion and by being engaged with the reduced-diameter portion.

2. The fluid pressure cylinder according to claim 1, further comprising a cylindrical collar interposed between the sensor body and the plug.

3. The fluid pressure cylinder according to claim 1, further comprising:

an outer-side female screw portion disposed in the through hole at outer side of the pin hole, the outer-side female screw portion having a female screw formed on an inner circumference thereof; and an outer plug screwed into the outer-side female screw portion from the outer side.

4. The fluid pressure cylinder according to claim 2, wherein press pressure by the plug acts only on an outer circumferential portion of the sensor body via the collar.

5. The fluid pressure cylinder according to claim 4, further comprising a wire that extends from a back side of the sensor body into inner side of the collar.

6. The fluid pressure cylinder according to claim 5, wherein the bottom portion of the cylinder tube further has a wire guide hole, one end of the wire guide hole opening at the through hole, other end of the wire guide hole opening at a side surface of the bottom portion, and the collar has a hole for inserting the wire at a position corresponding to the wire guide hole.

* * * * *